US005595159A

United States Patent [19]

Huber et al.

[11] Patent Number: 5,595,159

[45] Date of Patent: Jan. 21, 1997

[54] METHOD AND ARRANGEMENT FOR CONTROLLING THE POWER OF AN INTERNAL COMBUSTION ENGINE

[75] Inventors: Werner Huber, Schwaikheim; Martin Streib, Vaihingen, both of Germany

[73] Assignee: Robert Bosch GmbH, Stuttgart, Germany

[21] Appl. No.: 378,020

[22] Filed: Jan. 25, 1995

[30] Foreign Application Priority Data

Feb. 15, 1994 [DE] Germany ..... 44 04 668.5

[51] Int. Cl.[6] ..... F02D 41/06

[52] U.S. Cl. ..... 123/362; 123/396

[58] Field of Search ..... 123/361, 362, 123/350, 399, 320, 396

[56] References Cited

U.S. PATENT DOCUMENTS 4,691,676 9/1987 Kikuchi ..... 123/399

5,349,932 9/1994 Boverie et al. ..... 123/399

FOREIGN PATENT DOCUMENTS 1603921 12/1981 United Kingdom .

*Primary Examiner*—Andrew M. Dolinar

*Attorney, Agent, or Firm*—Walter Ottesen

[57] ABSTRACT

The invention is directed to a method and an arrangement for controlling the power of an internal combustion engine. A power adjusting unit or the air supplied to the engine is adjusted in dependence upon driver command. The mixture adaptation is improved for rapid changes of the driver command when the engine is cold and/or when the ambient air is cold by limiting the rate of change of the supplied air or of the position of the power adjusting unit.

8 Claims, 2 Drawing Sheets

METHOD AND ARRANGEMENT FOR CONTROLLING THE POWER OF AN INTERNAL COMBUSTION ENGINE

BACKGROUND OF THE INVENTION

A method and an arrangement for controlling the power of an internal combustion engine are disclosed in British Patent 1,603,921. In this patent, a throttle flap in the intake system of the internal combustion engine is adjusted in the context of a position control circuit in order to control the power of the engine in dependence upon the driver command. The rate of change of the throttle flap is limited in dependence upon the rpm of the engine in order to adapt the time response of the displacement of the accelerator pedal and of the throttle flap to the dynamic conditions of the mixture formation of the mixture and of the mixture transport. With this measure, a reduced emission of toxic substances occurs in the transient range.

The optimal rate of conversion of a catalytic converter lies in a very narrow window of the air/fuel ratio. For steady state or quasi steady state operating states of the engine, the exhaust-gas control ensures that this window is maintained as exact as possible. If the driver suddenly depresses the accelerator pedal, then the air quantity or air mass supplied to the engine increases rapidly. If the increase of the air quantity or air mass drops in a time interval wherein the metering of fuel for a cylinder has already taken place, but the intake operation has not ended, then this causes the condition that the cylinder is supplied with a mixture which is too lean. If the mixture is still capable of being ignited, then the nitrogen oxide emissions thereby increase. If the mixture is no longer capable of being ignited, then the hydrocarbon emissions increase.

Furthermore, a so-called gap in acceleration occurs which is a situation wherein the motor vehicle no longer accelerates directly with the actuation with the accelerator pedal and the engine rpm no longer increases directly with the actuation of the accelerator pedal. If the driver suddenly lets go of the accelerator pedal, then the situation can occur that a cylinder, for which fuel has already been injected, is supplied with a quantity of air which is too little in comparison to the quantity of fuel already injected. This results in a mixture which is too rich and which has increased carbon monoxide and hydrocarbon emissions.

Furthermore, it is difficult to exactly compute the quantity of air supplied to the individual cylinders when there are rapid changes of the throttle flap because of the impreciseness in the transport of the fuel mixture to the cylinder. In this way, the computation of the required fuel quantity exhibits a certain inaccuracy. This inaccuracy cannot the compensated by the exhaust-gas control because of its time constants. An improvement in this regard is obtained by the electric control of the throttle flap in dependence upon the driver command when the driver command is filtered in such a manner that a sudden depression of the accelerator pedal is transmitted to the throttle flap only after being smoothed. With this measure, the rate of change of the air quantity supplied to the cylinders is limited. In this way, the mismatch between air and fuel quantities can be reduced.

In the state of the art, the speed of changing the throttle flap is generally limited in dependence upon the engine rpm. Such a limitation of the throttle flap displacement speed operates independently of the operating states in which the above-mentioned mismatch occurs more often. Such operating conditions are especially the warm-up of the engine and when the ambient air is colder. Accordingly, the disadvantage of the rpm dependent limitation is that the motor vehicle only reacts with delay to a depression of the accelerator pedal independently of the problematic of the exhaust gas and therefore driving performance is reduced.

SUMMARY OF THE INVENTION

In view of the foregoing, it is an object of the invention to provide measures which limit the speed of displacement of a power-determining actuating element to reduce the emission of toxic substances without reducing the operating performance of the vehicle.

A further object of the invention is to provide measures which effect a reduction of the emission of toxic substances only in operating ranges in which an increased output of toxic substances is to be expected.

Another object of the invention is to provide measures which effect a reduction of the emission of toxic substances independently of an existing control system for the composition of the exhaust gas.

Another object of the invention is to provide measures which effect a reduction of the emission of toxic substances for a cold engine and/or in cold ambient conditions.

Still another object of the invention is to provide measures which effect a reduction of the emission of toxic substances by influencing the air supplied to the engine.

The advantages of the invention will now be described.

With the procedure provided by the invention, a reduced mismatch of the mixture is obtained during rapid accelerator pedal movement by the driver and therefore a reduced emission of toxic substances is realized.

Intense leaning of the mixture and therefore the occurrence of interruptions or gaps in acceleration occurring when the accelerator pedal is suddenly depressed are avoided and the driving performance of the engine is thereby improved.

The procedure provided by the invention is especially significant during warm-up of the engine and/or when the ambient air is cold. The above-mentioned effects with respect to mixture mismatches are then critical when the engine has not yet reached its normal operating temperature. In such operating states, a relatively larger portion of the injected fuel is not supplied for the combustion; instead, this injected fuel deposits in the intake pipe as a wall film forming a store. Mismatches of this kind are avoided by the procedure provided by the invention especially for cold engines such as those in the transition stage from cold to warm running and/or in cold ambient air.

It is especially advantageous that the improvement of the exhaust-gas emission is achieved independently of the existing exhaust-gas control. By limiting the rate of change of the air quantity supplied to the engine, it is further achieved that corrective intervention of an exhaust-gas control having greater time constants is effective.

The dynamic of the motor vehicle with an actuation of the accelerator pedal is not significantly affected by limiting the rate of change of the air supplied to the engine that is the rate of change of the throttle flap movement in dependence upon the intake air temperature, engine temperature and/or the time which has elapsed since the start.

In addition to a common combined evaluation of the intake-air temperature, engine temperature and the time elapsed since the start of the engine, only two or only one of these variables is evaluated in other advantageous embodiments.

It is especially advantageous that the extent of the limitation is selected differently in dependence upon the direction of the actuation of the accelerator pedal. In this context, the limitation of the rate of change when releasing the accelerator pedal is advantageously selected so as to be greater than when depressing the accelerator pedal. When the accelerator pedal is released, a delayed reaction has no effect on driving performance. Further, the hydrocarbon emissions, which occur especially when the accelerator pedal is released, are reduced by a greater dynamic limitation. When the accelerator pedal is depressed, the limitation of the dynamic is reduced to obtain satisfactory response performance of the engine and driving performance of the motor vehicle.

It is especially advantageous that the limiting of the rate of change of the air supply for a rapid opening of the throttle flap can be less when a correcting quantity of fuel is injected which is in addition to the injection pulse and which is independent thereof. This quantity of fuel is known as afterinjection because it is formed in time after the actual injection pulse on the basis of the actual operating variable because of conditions then present and is injected shortly in advance of the intake of the particular cylinder.

A preferred realization of the procedure of the invention exhibits special advantages which comprise limiting the rate of change of the air quantity. In this way, the nonlinearity of the relationship between throttle flap position and inducted air quantity is compensated.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
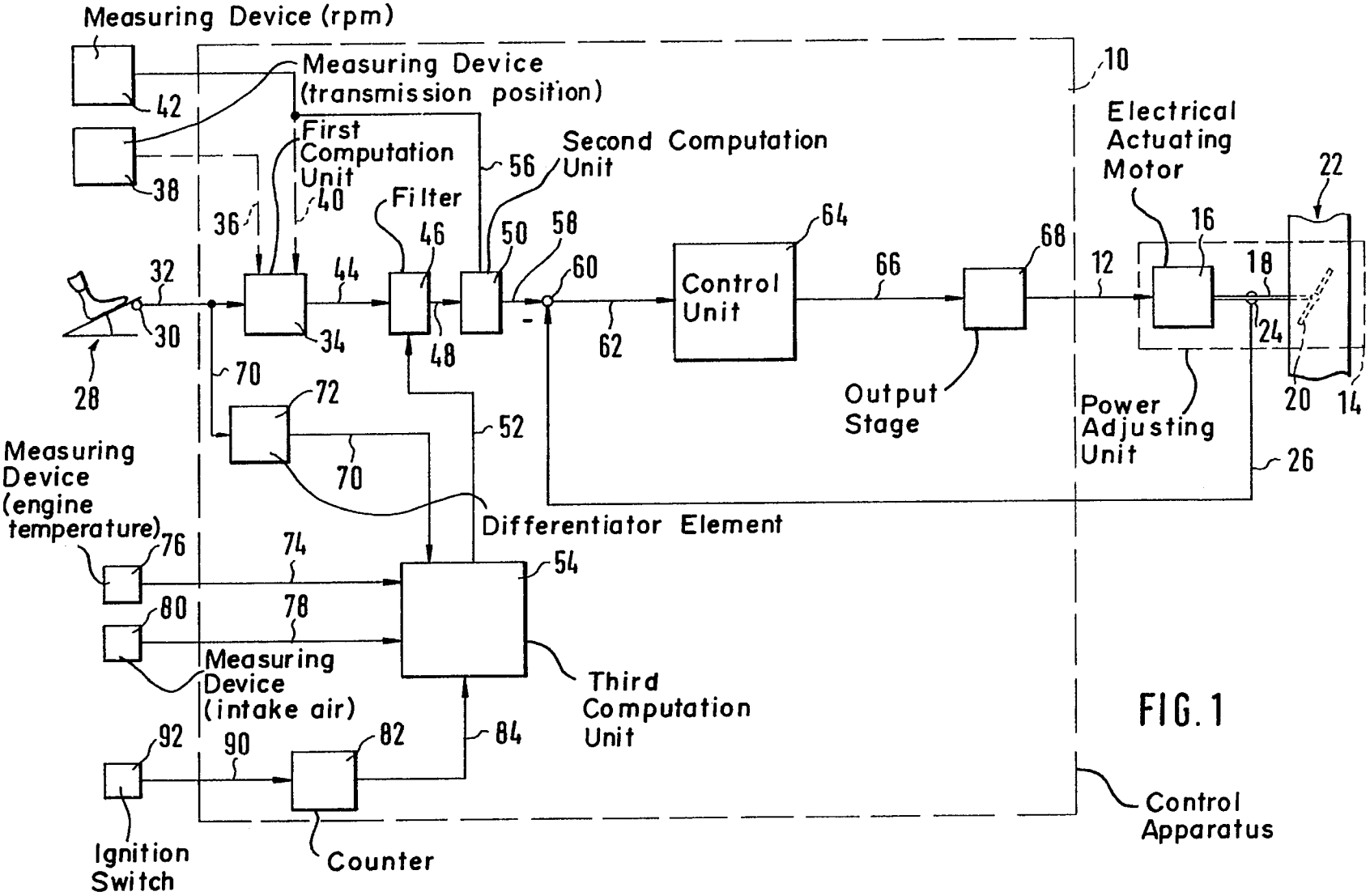
FIG. 1 is an overview block diagram of a control apparatus for the power of an internal combustion engine wherein the method according to the invention is realized; and, FIG. 2 is a flowchart illustrating the control method for the power of an internal combustion engine.

In FIG. 1, reference numeral 10 identifies a control apparatus for an internal combustion engine (not shown). The control apparatus 10 drives a power adjusting unit 14 via an output line 12. The power adjusting unit 14 comprises an electrical actuating motor 16, a mechanical connection 18 and a throttle flap 20 mounted in the intake air system 22 of the engine. The actuating motor and the throttle flap are connected to each other via the mechanical connection 18. Furthermore, a position transducer 24 is provided which leads to the control apparatus 10 via a line 26.

An accelerator pedal 28 is actuated by the driver and is provided with a further position transducer 30. A line 32 connects the position transducer 30 to the control apparatus 10 and leads within the control apparatus to a first computation unit 34. In a preferred embodiment, the computation unit 34 defines a characteristic field. A measuring device 38 for detecting the transmission position is connected to the unit 34 via a line 36 (shown broken) and a measuring device 42 for detecting the rpm of the engine is connected via a line 40 (also shown broken) to the computation unit 34. The output line 44 of the unit 34 leads to a filter element 46 having output line 48 leading to a second computation unit (characteristic field) 50. A line 52 from a third computation unit 54 is connected to the filter element 46 while a line 56 from the measuring device 42 is connected to the second computation unit 50. The output line 58 of the unit 50 leads to a comparator unit 60 which also receives the line 26. The output line 62 of the comparator unit 60 leads to a control unit 64 and the output line 66 of the control unit 64 leads via an output stage 68 to the output line 12 of the control unit 10. A line 70 leads from the line 32 via a differentiator element 72 to the comparator unit 54. In a preferred embodiment, the following are also connected to the computation unit 54: a line 74 from a measuring device 76 for detecting the temperature of the engine, a line 78 from a measuring device 80 for detecting the temperature of the intake air and a line 84 from a counter 82. A line 90 from the ignition switch 92 is connected to the counter 82.

The driver issues a command via the position of the accelerator pedal 28. This command is converted in the first computation unit (characteristic field) 34, as required on the basis of the transmission positions and the engine rpm into an air-quantity desired value. The air-quantity desired value is transmitted to the characteristic field 50 via the line 44, the filter element 46 and the line 48. There, the air-quantity desired value is converted into a desired position value for the throttle flap 20 while taking into account the engine rpm. This desired position value is logically combined with the actual value of the throttle flap position in the comparator unit 60 and the difference (the control deviation) is supplied via the line 62 to the control unit 64. The control unit 64 determines a drive signal quantity for adjusting the throttle flap in the sense of bringing the actual value close to the desired value. This determination in control unit 64 is made pursuant to a pregiven control strategy utilizing, for example, a controller having a proportional, integral and/or differential response. This drive signal is outputted via the line 66, the output stage 68 and the output line 12 to the power adjusting unit 14 where it is outputted to the electrical actuating motor 16 which effects a displacement of the throttle flap 20 in a direction to cause the actual value to come close to the desired value.

Outside of transient operation (when the driver does not actuate the accelerator pedal or actuates it only slowly), the filter element 46 exhibits no or only a very slight filtering action. The filtering action is amplified in the transient state when the change of the accelerator-pedal position is greater than a predetermined limit value (that is, the accelerator pedal actuation takes place rapidly). The computation unit 54 is provided to limit the rate of change of the air quantity displacement in this operating state. The computation unit 54 receives a signal for the engine temperature via the line 74 and a signal for the intake air temperature via the line 78. The computation unit 54 further receives a signal for the time elapsed since the start of the engine via the line 84 and a signal for the time-dependent change of the accelerator-pedal position via the line 70. The computation unit 54 evaluates the signals supplied thereto and forms a control signal therefrom on line 52 which activates the filter element 46, that is, the control signal changes the filter time constant.

In a preferred embodiment, the filter element 46 is a low-pass filter of the first order having a time constant which can be changed by the computation unit 54. The filter element 46 can be configured analog or, in the context of a preferred embodiment, digitally as part of a computer program. In addition to the configuration as low-pass filter of the first order, it can be advantageous in other embodiments to configure the filter element 46 as a low-pass filter of the second order or to select another filter structure known to persons in the field.

The computation unit 54 computes the filter constant in dependence upon its input signals, that is, the extent of the smoothing of the air-quantity desired value or air-mass desired value. The procedure provided by the invention improves the mixture adaptation when the engine is cold. For this reason, the filter action of the filter element 46 is greater the lower the engine temperature is and/or the colder the intake air temperature is. In addition, the filter action is weaker the greater the time elapsed after the start of the engine. The accelerator-pedal position is differentiated in the differentiator element 72 in order to not overly affect the driving performance of the vehicle and to ensure the effective action of the filtering especially when the accelerator pedal is released rapidly. If the time-dependent change of the accelerator-pedal position is positive (that is, the accelerator pedal is depressed), the filter action is adjusted by the computation unit 54 so as to be weaker than for a negative time-dependent change of the position of the accelerator pedal (that is, when the accelerator pedal is released). The differentiation of the position of the accelerator pedal takes place by means of a comparison of two sequential measurement values of the accelerator-pedal position. In a low-pass filter in accordance with a preferred embodiment of the invention, the filter action is greater the greater the filter constant is.

The selection of the dependency of the filter constant and therefore the extent of the limiting of the operating variable(s) is determined experimentally. A compromise is then to be found between an adequate reaction of the engine to an actuation of an accelerator pedal and a reduction of the toxic emissions. It has been shown that the emission of toxic substances can be significantly reduced without noticeably slowing the reaction of the engine.

The illustrated embodiment shows a filtering of the accelerator-pedal position signal or of the air-quantity desired value signal. In addition to this embodiment, another advantageous embodiment provides for limiting the change of the air quantity in that: a time-dependent derivative of the change of the air quantity is formed; the derivative is compared to a desired value determined from measured values by the computation unit 54; and, the air-quantity desired value is influenced in such a manner that the actual value of the air-quantity change corresponds to the desired value of the air-quantity change.

Smoothing of the air-quantity desired value or air-mass desired value is provided in the preferred embodiment described above. In addition to this, and in other embodiments, the speed of adjustment of the desired value for the throttle flap angle (line 58) or the actuating variable for the power adjusting unit (line 66 or 12) are correspondingly limited or filtered.

Figure 2:
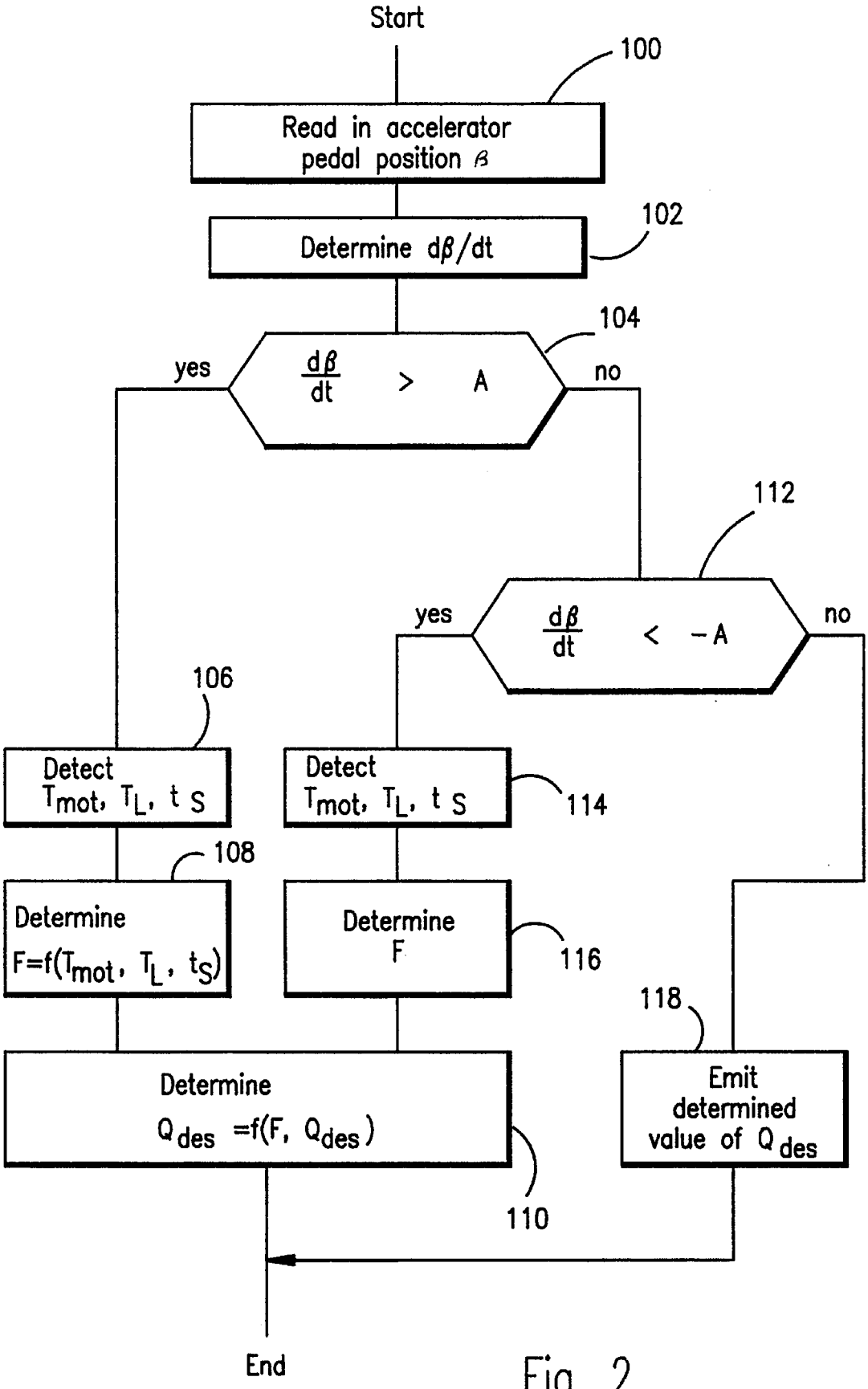

FIG. 2 shows a subprogram for carrying out the method of the invention in the context of a computer program.

After start of the subprogram, the accelerator-pedal position $\beta$ is read in in a first step 100. Then, in step 102, the time-dependent derivative of the accelerator-pedal position is formed on the basis of the actual measured position $\beta$ and on the basis of the position $\beta$ detected in a previous program runthrough (preferably in the immediately preceding program runthrough. This derivative is compared in step 104 to a predetermined positive limit value A. The value A is then so selected that no negative effects are to be feared on the toxic emission for speed changes less than A. If the accelerator pedal change exceeds this value A, then a rapid accelerator-pedal actuation is present which causes the initially-mentioned disadvantages with respect to mixture adaptation. If this is indeed the case, then, in step 106, the following are detected: the temperature $T_L$ of the intake air, the engine temperature $T_{mot}$ and/or the time $t_S$ elapsed since the start of the engine and, in the next computation step 108, the filter constant F is determined as a function of the intake-air temperature, engine temperature and/or the time elapsed since the start. Thereafter, in step 110, the air-quantity desired value $Q_{des}$ is determined on the basis of the actually-measured accelerator-pedal position value $\beta$ and, if required, additional operating parameters. Thereafter, and in accordance with a low-pass filter function of the first order, the air-quantity desired value $Q_{des}$ is filtered with a filter constant value determined in step 108. The throttle flap angle desired value is formed from the filtered air quantity desired value $Q_{des}$ while taking into account the engine rpm. Thereafter, the subprogram is ended.

If it is detected in step 104 that the time-dependent derivative of the accelerator-pedal position is not greater than the limit value A, then, in step 112, a check is made as to whether the time-dependent derivative of the accelerator pedal position is less negative than the negative value of the limit value A. If this is the case, then similar to step 106, the intake-air temperature, engine temperature and/or the time elapsed since the start are detected in step 114 and, in the next step 116, the filter constant F is determined from a characteristic field on the basis of these operating variables for the case when the accelerator pedal is released. In the next step 110, the determined $Q_{des}$ value is filtered with the determined filter constant F in correspondence to the low-pass function of the first order. Thereafter, the subprogram is ended.

If it is detected in step 112 that no rapid accelerator pedal movement in the direction of closure has taken place, then it can be assumed that a steady state or quasi steady state operating condition is present and, in step 118, the determined $Q_{des}$ value is outputted directly without filtering or with reduced filtering to form the throttle flap desired angle. The subprogram is ended after step 118 and is repeated at a predetermined time.

In addition to the embodiment of step 118 in accordance with which no filtering takes place for steady state or quasi steady state operating condition, a slight filtering can be provided in order to suppress fluctuations or noise of the desired value.

In addition to the common combined evaluation of the intake-air temperature, engine temperature and time after start, only two or only one of these parameters can be provided in other advantageous embodiments.

It is understood that the foregoing description is that of the preferred embodiments of the invention and that various changes and modifications may be made thereto without departing from the spirit and scope of the invention as defined in the appended claims.

What is claimed is:

1. A method of controlling the power of an internal combustion engine of a vehicle equipped with an electrically adjustable power adjusting element which influences the air supplied to the engine in dependence upon a command of the driver, the method comprising the steps of:

detecting at least one operating variable in operating states in which an increased emission of toxic substances can be expected during a transient operating phase; and, limiting the rate of change of adjusting said power adjusting element in dependence upon said at least one operating variable which includes at least one of the following: temperature of the engine, temperature of the inducted air and the time elapsed since the engine was started.

2. A method of controlling the power of an internal combustion engine of a vehicle equipped with an electrically adjustable power adjusting element which influences the air supplied to the engine in dependence upon a command of the driver, the method comprising the steps of:

detecting operating variables in operating states in which an increased emission of toxic substances can be expected during a transient operating phase;

limiting the rate of change of adjusting said power adjusting element in dependence upon said operating variables;

determining a desired value for the quantity of air supplied to the engine; and, limiting the rate of change of said desired value.

3. The method of claim 2, further comprising the step of filtering said desired value with a filter function which changes in dependence upon said operating variables.

4. The method of claim 3, said filter function being a low pass filter of the first order.

5. The method of claim 3, wherein said engine includes a throttle flap and the method further comprising the step of: detecting the rpm of said engine; and, determining a desired value for the position of said throttle flap from said desired value for the air quantity while taking said rpm into account.

6. The method of claim 3, wherein the filter action is less when there are positive changes in the quantity of air than for negative jumps.

7. The method of claim 6, wherein said engine includes an accelerator pedal; and, said filter action for said positive changes is characterized by depressing the accelerator pedal and limiting said rate of change and said negative jumps are characterized by a release of said accelerator pedal.

8. An arrangement for controlling the power of an internal combustion engine, the engine having an accelerator pedal and a power adjusting element for influencing the air supplied to the engine, the arrangement comprising:

a control apparatus for generating an input signal to actuate said power adjusting element;

means for inputting a driver command to said control apparatus; and, said control apparatus including means for limiting the rate of change of the position of said power adjusting element; and, means for making said limiting less when there is a positive change of said driver command defined by an actuation of said accelerator pedal than when there is a negative change of said driver command defined by a release of said accelerator pedal.

* * * * *